United States Patent [19]

Aoki

[11] Patent Number: 4,665,561

[45] Date of Patent: May 19, 1987

[54] BASEBALL GLOVE HAVING FINGER STRAPS

[75] Inventor: Akio Aoki, Hirakata, Japan

[73] Assignee: Trion Corporation, Japan

[21] Appl. No.: 749,044

[22] Filed: Jun. 26, 1985

[30] Foreign Application Priority Data

May 16, 1985 [JP] Japan ..... 60-72657[U]

[51] Int. Cl.[4] ..... A41D 13/10

[52] U.S. Cl. ..... 2/19; 2/161 A

[58] Field of Search ..... 2/19, 163, 16, 160, 2/161 A, 161 R, 158, 20, 18; 441/56, 57, 58

[56] References Cited

U.S. PATENT DOCUMENTS

| | | | |
|---|---|---|---|
| D. 225,044 | 11/1972 | Bates | 2/19 |
| 1,535,896 | 4/1925 | Bociek | 441/58 |
| 1,562,176 | 11/1925 | Latina | 2/19 |
| 2,159,972 | 5/1939 | Larson | 441/58 |
| 2,354,601 | 7/1944 | Latina | 2/19 |
| 2,778,023 | 1/1957 | Tompkins | 2/19 |
| 2,988,744 | 6/1961 | Stobbe | 2/19 |
| 3,246,621 | 4/1966 | Copeland | 2/2.1 R |
| 4,293,957 | 10/1981 | Melavie | 2/2.1 R |

*Primary Examiner*—Louis K. Rimrodt
*Assistant Examiner*—Joseph S. Machoga
*Attorney, Agent, or Firm*—Jones, Tullar, & Cooper

[57] ABSTRACT

The disclosed invention consists in a baseball glove comprising a strap for receiving at least first to third fingers of a player. The strap is disposed at positions outside and spaced from inlets of finger pieces of the glove and is retained in position by a ply opposed to front faces of the strap.

4 Claims, 6 Drawing Figures

BASEBALL GLOVE HAVING FINGER STRAPS

BACKGROUND OF THE INVENTION

This invention relates to gloves used in the game of baseball.

Recent baseball gloves are designed very large to provide a maximum ball receiving area in order to facilitate catches. The gloves have as large an area as about five times that of a human hand.

The large baseball glove, because of its large area, has the advantages of easy ball catching but tends to deprive the player of free and subtle hand movements when catching a ball.

When the player bends his thumb and fingers inwardly for catching a ball, the inner surface or front ply of the glove bends to follow a bowl shape defined by the front faces of the thumb and fingers in combination. The ball hitting the front ply of the glove is guided by the bowl shape of the front ply to a position centrally of the player's hand lying about the center of the front ply.

However, when such a large glove is used by a woman or child having small hands or by a small-handed man, his or her thumb and fingers do not extend fully into the thumb and finger pieces of the glove but may even stop short of inlet portions of the thumb and finger pieces. When the small-handed player bends his thumb and fingers inwardly, it only results in his fingertips pushing the lining ply of the glove forwardly and causing a portion of the lining ply opposed to the palm of his hand to move away from his hand. Consequently, the portion of the lining ply opposed to the palm of the player's hand cannot be inwardly moved closer to the hand than the fingertip positions are. It is therefore impossible to bend the entire inner surface of the glove into a bowl shape. In other words, the entire inner surface of the glove remains a near-flat surface in spite of the inward bending of the thumb and fingers of the player. Because the inner surface of the glove is not in a bowl shape, a ball hitting inner surface portions of the glove adjacent the player's thumb and fingers or the tip ends thereof cannot be guided toward the center of the glove. It has been found that there is a danger in such a case of spraining the fingers.

Thus, the known gloves have the drawbacks not only of ball catching difficulty but of finger spraining likelihood where the player's hand is too small relative to the size of the glove.

SUMMARY OF THE INVENTION

The object of the invention is to overcome the disadvantages of the prior art noted above. In order to achieve this object a baseball glove according to this invention comprises strap means disposed at positions outside and spaced from inlets of finger pieces of the glove to receive at least the first to third fingers of a player, the strap means being retained in position by a ply opposed to front faces of the strap means.

With the glove as described above, when the user bends his thumb and fingers forward, crotch portions of the thumb and fingers, by using the strap means, prevent ply portions opposed thereto from moving forward and his fingertips, on the other hand, push the ply forward relative to the ply portions opposed to the crotch portions of the player's thumb and fingers.

More particularly, when the thumb and fingers of the player are bent, the ply portions opposed to front faces of his fingertips are pushed forward relative to the ply portions opposed to the crotches of the thumb and fingers, whereby the front or inner surface of the glove assumes a shape similar to a bowl interior. This causes the finger pieces of the glove disposed outwardly of the ply portions corresponding to inner bowl peripheries to move positions close to extension planes of the bowl interior. Thus, by curving a small hand in a large glove, the glove is curved to a shape similar to the bowl interior.

This construction permits a ball hitting peripheral portions of the thumb and finger pieces to be guided to the center of the palm. Therefore, a very small hand relative to the glove can catch balls with ease and with little chance of spraining the fingers.

Other advantages of this invention will be apparent from the following description.

BRIEF DESCRIPTION OF THE DRAWINGS

The drawings illustrate a baseball glove embodying this invention, in which.

DESCRIPTION OF THE PREFERRED EMBODIMENTS

Figure 1:
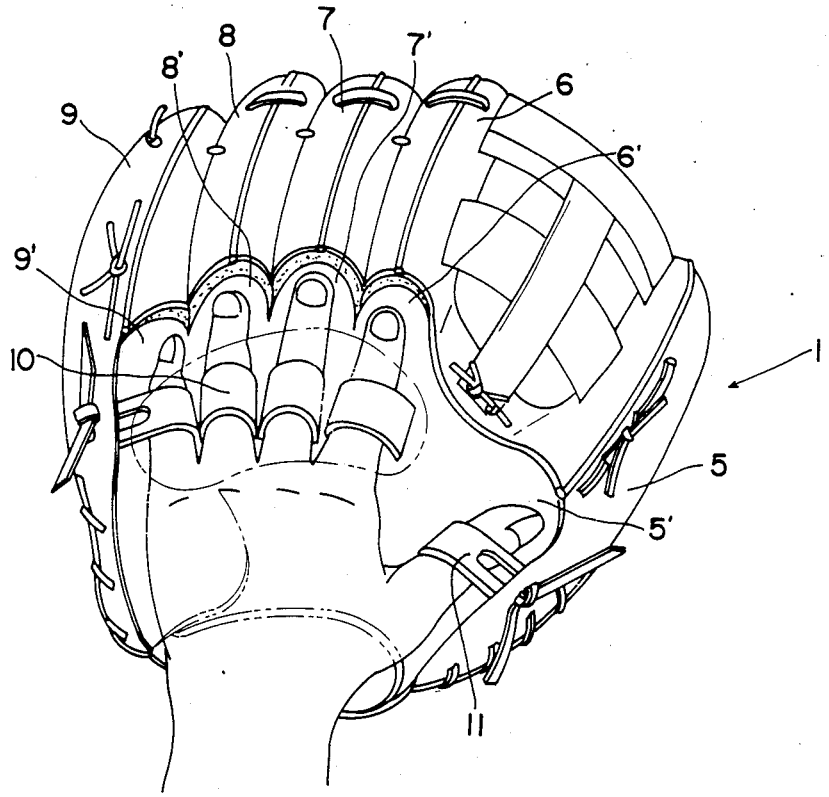
FIG. 1 is a partly broken away perspective view of a first embodiment.
Figure 2:
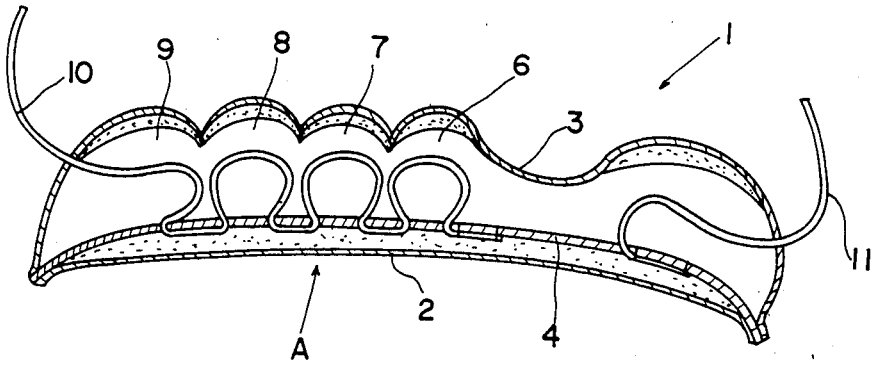
FIG. 2 is a view in vertical section of a principal portion of the first embodiment.

Referring to FIGS. 1 and 2, a glove 1 according to this invention comprises a front ply 2 defining a ball catching area A, a back ply 3, and a lining ply 4 contacted by a front or palm side of a player's hand.

The glove 1 further comprises thumb and finger pieces 5–9 having finger inlet portions 5'–9', respectively. Finger pieces 6, 7 and 8 correspond respectively to the first, second and third fingers wherein the first finger denotes a finger adjacent to the thumb. There are finger and thumb straps 10 and 11 formed of a strip provided on positions of the lining ply 4 opposed to the ball catching are A and outside and spaced from the finger inlet portions 5'–9'. The finger strap 10 which receives the four fingers is passed through the lining ply 4 like a sewing thread. One end of the strap 10 is stitched to the lining ply 4 or the front ply 2 and the other end extends outwardly of the back ply 3, so that the finger inlets, or loops, are adjustable with respect to their length. The other strap 11 is used only for the thumb, and like-wise forms a loop. It has one end thereof stitched to the lining ply 4 and the other end extending outwardly of the back ply 3 to be capable of tightening adjustment.

Figure 3:
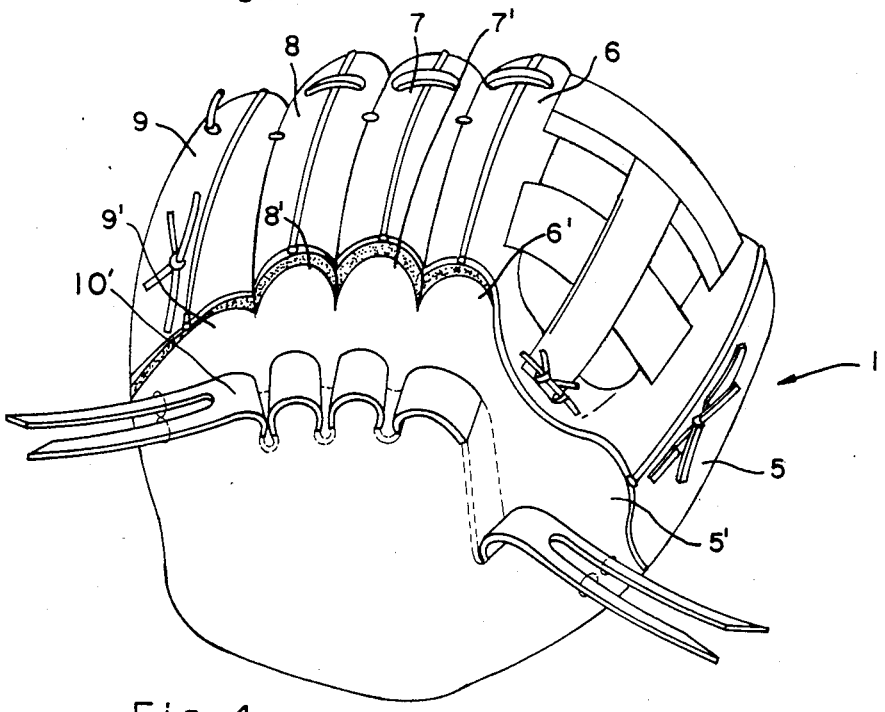
FIG. 3 is a perspective view of a principal portion of a second embodiment.

Referring to FIG. 3, the embodiment shown therein includes one continuous thumb and finger strap 10' as distinct from the two separate straps 10 and 11 in the foregoing embodiment. The strap 10' is adjustable with respect to its length by means of knots at the respective ends thereof. This embodiment using the single strap has the advantage of simple construction.

Figure 4:
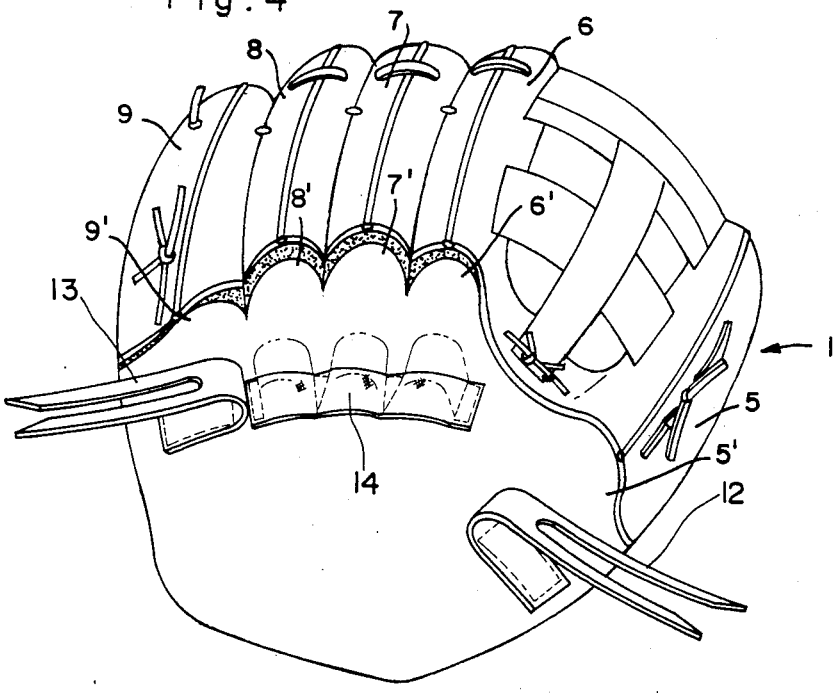
FIG. 4 is a perspective view of a principal portion of a third embodiment.

Referring to FIG. 4, the embodiment shown therein includes a thumb strap 12, a little finger strap 13 and a strap 14 for the first to third fingers. The straps 12 and 13 comprise known constructions as they are. The strap 14 is formed of a flexible strip which dispenses with tightening adjustment of the strap per se for receiving the three intermediate fingers.

The straps in this and other embodiments may be attached to the lining ply 4 or the front ply 2 by other means than stitching. For example, the straps may be bonded to the ply 4 or 2.

The strap 14 may comprise a slightly elastic material. Then a large-handed person can use the glove just by passing his fingers over the strap 14; it is not necessary to remove the strap 14.

Figure 5:
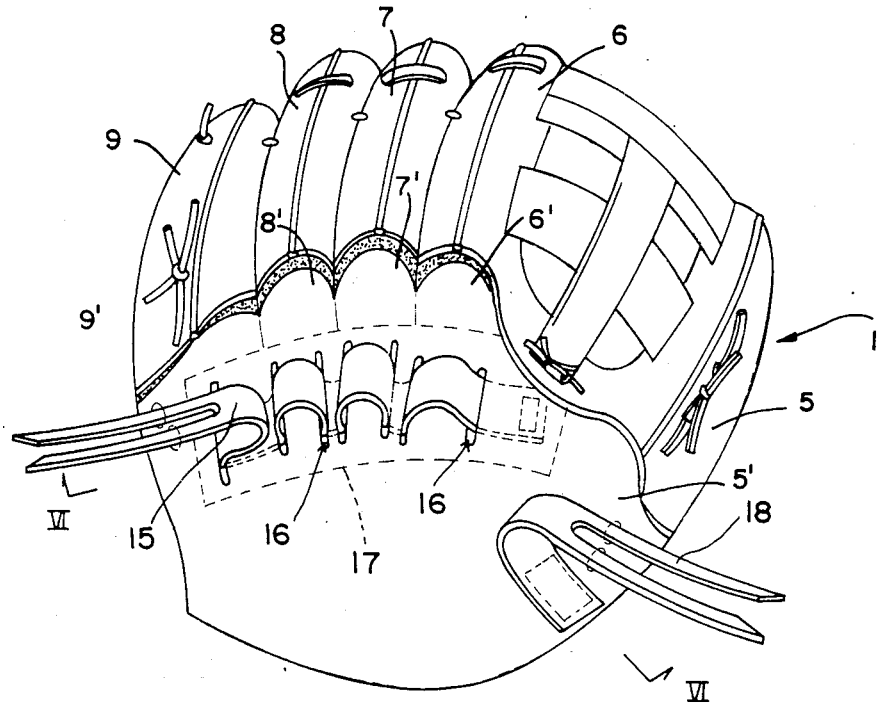
FIG. 5 is a perspective view of a principal portion of a fourth embodiment.
Figure 6:
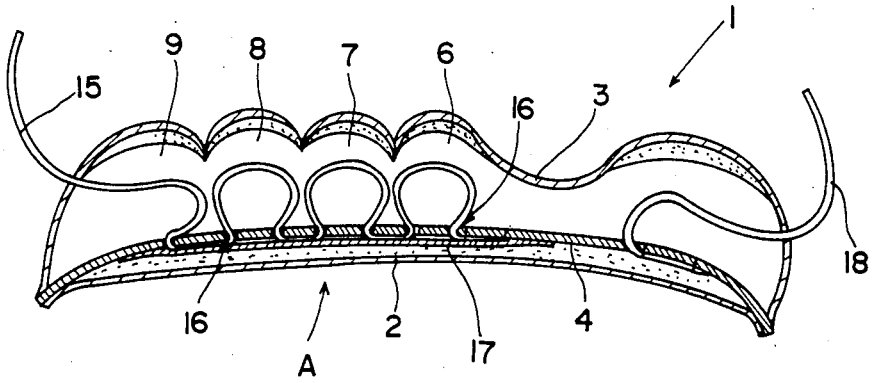
FIG. 6 is a sectional view taken on line VI—VI of FIG. 5.

Referring to FIGS. 5 and 6, the embodiment shown therein includes a finger strap 15 for four fingers and a separate thumb strap 18. The finger strap 15 has a first-finger end fixed in position by stitching and the other end knotted so that the strap 15 is adjustable with respect to its length. This embodiment differs from the preceding embodiments in slits 16 defined in the lining ply 4. The slits 16 in this embodiment have greater longitudinal dimensions than a width of the strap 15 longitudinally of the fingers. This arrangement, in combination with the length adjustment by means of the knot, permits the strap 15 to be adjustable back and forth and right and left.

This embodiment further includes a patch 17 attached to an inside surface of the lining ply 4 so as to cover the slits 16. The patch 17 serves to prevent leakage of grease placed between the lining ply 4 and the front ply 2 and to prevent the slits 16 from becoming large.

I claim:

1. A base ball glove including;

a front ply;

a back ply;

a lining ply situated between the front ply and the back ply, said plies being joined together, said back and lining plies defining a plurality of finger pieces, each having an inlet for receiving the fingers of a player's hand, said lining ply having a plurality of slits formed therein; and at least one finger strap including at least one strip member having a width longitudinally of the finger pieces and extending through said slits to be between said back ply and said lining ply to form loops situated adjacent to and outside of the inlets of at least three of the finger pieces and between said back ply and said lining ply, said loops being adapted to receive corresponding fingers of a player's hand.

2. The baseball glove as defined in claim 1, wherein the length of the slits is greater than the width of the finger straps.

3. The baseball glove as defined in claim 2, wherein the finger straps are adjustable along their length thereby adjusting the size of said loops.

4. The baseball glove or defined in claim 1, wherein the finger straps are adjustable along their length thereby adjusting the size of said loops.

* * * * *